US009980056B2

(12) United States Patent
Wurzbacher et al.

(10) Patent No.: US 9,980,056 B2
(45) Date of Patent: May 22, 2018

(54) METHOD, DEVICE, AND SYSTEM FOR SUPPRESSING FEEDBACK IN HEARING AID DEVICES WITH ADAPTIVE SPLIT-BAND FREQUENCY

(71) Applicant: SIVANTOS PTE. LTD., Singapore (SG)

(72) Inventors: Tobias Wurzbacher, Fuerth (DE); Tobias Daniel Rosenkranz, Erlangen (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 238 days.

(21) Appl. No.: 14/830,948

(22) Filed: Aug. 20, 2015

(65) Prior Publication Data

US 2016/0057548 A1 Feb. 25, 2016

(30) Foreign Application Priority Data

Aug. 20, 2014 (DE) ..... 10 2014 216 536

(51) Int. Cl.
*H04R 25/00* (2006.01)

(52) U.S. Cl.
CPC ..... *H04R 25/45* (2013.01); *H04R 25/453* (2013.01); *H04R 25/554* (2013.01); *H04R 25/353* (2013.01); *H04R 2430/03* (2013.01)

(58) Field of Classification Search
CPC .... H04R 25/45; H04R 25/554; H04R 25/453; H04R 2430/03; H04R 25/353
USPC ..... 381/315
See application file for complete search history.

(56) References Cited

U.S. PATENT DOCUMENTS

| | | | | |
|---|---|---|---|---|
| 5,170,434 | A | 12/1992 | Anderson | |
| 5,721,783 | A * | 2/1998 | Anderson | H04B 1/385 381/312 |
| 8,355,517 | B1 * | 1/2013 | Fretz | H04R 25/453 381/317 |
| 8,411,885 | B2 | 4/2013 | Kornagel et al. | |
| 8,582,793 | B2 | 11/2013 | Baechler et al. | |
| 8,923,540 | B2 | 12/2014 | Boldt et al. | |
| 2004/0066946 | A1 * | 4/2004 | Buol | H04R 25/30 381/318 |
| 2005/0047620 | A1 * | 3/2005 | Fretz | H04R 25/453 381/318 |
| 2005/0226447 | A1 * | 10/2005 | Miller, III | H04R 25/453 381/318 |

(Continued)

FOREIGN PATENT DOCUMENTS

| | | | |
|---|---|---|---|
| DE | 3927765 | A1 | 3/1990 |
| DE | 102009018812 | A1 | 11/2010 |

(Continued)

*Primary Examiner* — Oyesola C Ojo
(74) *Attorney, Agent, or Firm* — Laurence A. Greenberg; Werner H. Stemer; Ralph E. Locher

(57) ABSTRACT

A method for suppressing acoustic feedback in a hearing aid device and a corresponding device and a system. A frequency range to be transmitted by the hearing aid device is divided into two frequency ranges that are separated by a split-band frequency. A transfer function of a feedback path is estimated in a frequency range and assessed for its behavior at the split-band frequency. Depending on the result of the assessment, the split-band frequency is lowered or raised and in the upper frequency range a phase and/or frequency change is applied for suppressing feedback.

19 Claims, 5 Drawing Sheets

(56) References Cited

U.S. PATENT DOCUMENTS

| | | | | |
|---|---|---|---|---|
| 2006/0291681 | A1* | 12/2006 | Klinkby | H04R 25/453 381/318 |
| 2009/0041272 | A1* | 2/2009 | Puder | H04R 25/453 381/318 |
| 2010/0128911 | A1* | 5/2010 | Elmedyb | H04R 25/453 381/320 |
| 2010/0202641 | A1* | 8/2010 | Guo | H04R 25/453 381/318 |
| 2010/0232634 | A1* | 9/2010 | Boldt | H04R 25/453 381/318 |
| 2010/0254555 | A1* | 10/2010 | Elmedyb | H04R 25/453 381/318 |
| 2010/0272289 | A1* | 10/2010 | Kornagel | H04R 25/453 381/94.3 |
| 2010/0290631 | A1* | 11/2010 | Petrausch | H04R 25/353 381/23.1 |
| 2010/0310103 | A1* | 12/2010 | Baechler | H04R 25/453 381/318 |
| 2011/0103613 | A1* | 5/2011 | Van Der Werf | H04R 25/453 381/93 |
| 2011/0188686 | A1* | 8/2011 | Munk | H04R 25/453 381/318 |
| 2015/0124998 | A1* | 5/2015 | Siegel | H04R 3/02 381/93 |

FOREIGN PATENT DOCUMENTS

| | | | |
|---|---|---|---|
| EP | 2003928 | A1 | 12/2008 |
| EP | 2244491 | A1 | 10/2010 |
| WO | 2008000842 | A2 | 1/2008 |

* cited by examiner

METHOD, DEVICE, AND SYSTEM FOR SUPPRESSING FEEDBACK IN HEARING AID DEVICES WITH ADAPTIVE SPLIT-BAND FREQUENCY

CROSS-REFERENCE TO RELATED APPLICATION

This application claims the priority, under 35 U.S.C. § 119, of German patent application DE 10 2014 216 536.9, filed Aug. 20, 2014; the prior application is herewith incorporated by reference in its entirety.

BACKGROUND OF THE INVENTION

Field of the Invention

The invention relates to a method for suppressing acoustic feedback in a hearing aid device, wherein a split-band frequency between a first frequency range with feedback suppression and a second frequency range without feedback suppression is adapted, and to a device and a system for carrying out the method.

Hearing aid devices are portable hearing devices which are used to supply those hard of hearing. In order to meet the numerous individual requirements, different designs of hearing aid devices such as behind-the-ear hearing devices (BTE), receiver in the canal (RIC) and in-the-ear hearing devices (ITE, ITC) e.g. also concha hearing devices or in-the-ear (ITE, CIC) hearing devices are provided. The hearing devices listed by way of example are worn at the outer ear or in the ear canal. In addition, bone conduction hearing aids, implantable or vibrotactile hearing aids are also available on the market. In this context, the damaged hearing is stimulated either mechanically or electrically.

In principle, hearing aids have as essential components an input transducer, an amplifier and an output transducer. As a rule, the input transducer is an acoustoelectrical transducer, e.g. a microphone and/or an electromagnetic receiver, e.g. an induction coil. The output transducer is mostly implemented as electroacoustic transducer, e.g. miniature loud speaker or as electromechanical transducer, e.g. bone conduction receiver. The amplifier is usually integrated into a signal processing device. The energy is usually supplied by a battery or a chargeable accumulator.

Because of the great closeness between the microphone and the electroacoustic output transducer, there is always a risk that an acoustic signal may be transmitted as sound through the air, either via a ventilation opening, a gap between the wall of the ear canal and the hearing aid device or an earpiece of the hearing aid device or in the interior of the hearing aid device or also as body sound via the hearing aid device itself. If then the overall gain of a feedback loop resulting from the signal processing in the hearing aid device and the attenuation between output transducer and microphone is greater than 1, a suitable phase shift of a signal, particularly if the phase shift is 0 or integral multiples of 2*pi, along this feedback loop can result in an oscillation which is perceived as an unpleasant whistle by the wearer.

To suppress feedback noises in hearing aid devices, various measures are known from the prior art. One possibility is to estimate the feedback signal, and thus the pulse response between earpiece and microphone (also called feedback path), by means of an adaptive filter. By means of this estimated pulse response, a signal having an inverted phase with respect to the feedback signal can be generated which is added to the microphone signal and thus extinguishes the feedback component. Since this estimation is subject to errors and wrong estimations can lead to interfering artifacts, it is advantageous to apply the filter adaptation and thus the estimation of the feedback component only above a split-band frequency (SFB).

It is known from the prior art that a frequency shift or a time-variable phase shift (e.g. a phase modulation) of the earpiece signal has an advantageous effect on the quality of the estimated feedback pulse response. However, superimposition of signal components which are unchanged in frequency and/or phase, and of frequency-shifted or phase-modulated signal components leads to interfering artifacts. Superimposition of these two signal components arises for two reasons: 1. Signal components delivered directly by the sensors become acoustically superimposed before the eardrum with signal components delivered by the earpiece. 2. Due to a finite edge steepness of the filters producing the split-band frequency, above which the signal is frequency shifted and/or phase modulated, signal components become electrically superimposed.

It is known from published patent application US 2010/0272289 A1, to place the split-band frequency into a frequency range which has little signal energy since it is also ensured in this manner that artifacts which, due to a simultaneous occurrence of phase-shifted and unchanged signals, due to electrical superimposition, also only have little energy and have a less interfering effect.

SUMMARY OF THE INVENTION

It is accordingly an object of the invention to provide a method and a corresponding device which overcome the above-mentioned and other disadvantages of the heretofore-known devices and methods of this general type and which provide for an improved method for feedback suppression and a hearing aid device with an improved feedback suppression.

With the foregoing and other objects in view there is provided, in accordance with the invention, a method for suppressing acoustic feedback in a hearing aid device. The hearing aid device has an acoustoelectric input transducer, a signal processing device, and an electroacoustic output transducer. The novel method comprising the following method steps:

dividing an acoustic frequency range transmitted by the hearing aid device into a first frequency range above a first split-band frequency and a second frequency range below the first split-band frequency;

estimating a first transfer function mapping a real transfer function of a feedback loop via the electroacoustic output transducer, an acoustic feedback path, the acoustoelectric input transducer and the signal processing device in the first frequency range;

assessing the first transfer function as to whether an exceeding of a predetermined limit value by the real transfer function is to be expected from a behavior of the first transfer function in an environment of the first split-band frequency;

if an exceeding of the predetermined limit value by the real transfer function is not to be expected in the environment of the first split-band frequency, increasing the first split-band frequency to a second split-band frequency, so that all values of a gain of the first transfer function for frequencies less than the increased second split-band frequency are less than the predetermined limit value; or if an exceeding of the predetermined limit value by the real transfer function is to be expected in the environment of the first split-band frequency, reducing the first split-band frequency to a second split-band frequency; and applying a phase or frequency change for feedback suppression in the signal processing only above an inception frequency in dependence on the second split-band frequency.

In other words, the method according to the invention relates to a method for suppressing acoustic feedback in a hearing aid device.

In one step, an acoustic frequency range transmitted by the hearing aid device is divided into a first frequency range above a first split-band frequency and a second frequency range below the first split-band frequency. In this context, it is conceivable that in the real implementation of the frequency division by filters, because of the finite steepness of edges, an overlap range is given which can be, e.g., 10 Hz, 50 Hz, 100 Hz or 200 Hz and in which an amplitude of a signal from the respective neighboring frequency range is attenuated, for example, by 6 dB, 12 dB or 18 dB.

In a further step, a first transfer function of a feedback loop via the electroacoustic output transducer, an acoustic feedback path, the acoustoelectric input transducer and the signal processing is estimated in the first frequency range. The estimated first transfer function is then a mapping of a real transfer function which is produced for the feedback loop from the acoustic environment (i.e. the estimated feedback pulse response) and the hearing aid device. To facilitate the estimating in the case of correlated signals, it is conceivable that a frequency shift and/or phase modulation is also carried out in a predetermined frequency range below the split-band frequency, for example at a fixed spacing of 50 Hz, 100 Hz or 200 Hz or in a predetermined dependence on the split-band frequency.

In another step, the first transfer function is assessed as to whether an exceeding of a predetermined limit value by the real transfer function is to be expected from the behavior of the first transfer function in the environment of the first split-band frequency. Various possibilities of evaluating the first transfer function are specified in the dependent claims.

If an exceeding of the predetermined limit value by the real transfer function is not to be expected in the environment of the first split-band frequency, the first split-band frequency is increased to a second split-band frequency so that all the values of a gain of the first transfer function of the feedback loop for frequencies less than the increased second split-band frequency are less than the predetermined limit value. In other words, the second split-band frequency is increased, at the most, up to a value below a limit frequency at which the gain of the closed feedback loop does just not exceed the limit value.

In one step of the method according to the invention, the first split-band frequency is reduced to a second split-band frequency if an exceeding of the predetermined limit value by the real transfer function is to be expected in the environment of the first split-band frequency. In other words, the second split-band frequency is reduced to a value below a limit frequency at which the gain of the feedback loop is expected to be less than the limit value.

Following this, a phase or frequency shift is applied for suppressing feedback in dependence on the second split-band frequency only above an inception frequency. The inception frequency can be below the second split-band frequency, for example, by a fixed amount of, for example, 50 Hz, 100 Hz or 200 Hz or assume a value of the second split-band frequency reduced by a linear or other predetermined factor.

The method according to the invention adapts, in dependence on the feedback path, the split-band frequency between a first frequency range in which a phase or frequency shift is necessary for preventing feedback and a second frequency range in which this is not required. Thus, the frequency range in which interfering artifacts occur due to the phase shift is advantageously minimized. In this context, the method also enables an evaluation or prediction of the real transfer function to be derived for a frequency range below the split-band frequency from an estimation of the first transfer function in the first frequency range. This is of advantage especially since an estimation is usually carried out only in a frequency range above a limit frequency, jeopardized by feedback, among other things also in order to save resources of the hearing aid device.

With the above and other objects in view there is provided, in accordance with the invention, a device for suppressing acoustic feedback in a hearing aid device, the hearing aid device having an acoustoelectric input transducer, a signal processing device, and an electroacoustic output transducer. The device for suppressing acoustic feedback comprises:

a signal connection to the hearing aid device;

a processing device configured to:

divide an acoustic frequency range to be transmitted by the hearing aid device into a first frequency range above a first split-band frequency and a second frequency range below the first split-band frequency;

estimate a first transfer function as mapping of a real transfer function of a feedback loop via the electroacoustic output transducer, an acoustic feedback path, the acoustoelectric input transducer, and the signal processing device in the first frequency range;

assess the first transfer function as to whether an exceeding of a predetermined limit value by the real transfer function is to be expected from the behavior of the first transfer function in an environment of the first split-band frequency;

if an exceeding of the predetermined limit value by the real transfer function is not to be expected in the environment of the first split-band frequency, increase the first split-band frequency to a second split-band frequency by such an amount that all the values of a gain of the first transfer function for frequencies less than the second split-band frequency are less than the predetermined limit value;

if an exceeding of the predetermined limit value by the real transfer function is to be expected in the environment of the first split-band frequency, reduce the first split-band frequency to a second split-band frequency; and adjust in the hearing aid device a phase or frequency change for feedback suppression in the signal processing device only above an inception frequency in dependence on the second split-band frequency.

In other words, the invention also relates to a device for suppressing acoustic feedback in a hearing aid device. The device has a signal connection to the hearing aid device, in particular, the device receives information from the hearing aid device relating to a signal received via the microphone and a signal output to the earpiece.

The device is configured to divide an acoustic frequency range to be transmitted by the hearing aid device into a first frequency range above a first split-band frequency and a second frequency range below the first split-band frequency.

The device is also configured to estimate a first transfer function of a feedback loop via the electro-acoustic output transducer, an acoustic feedback path, the acoustoelectric input transducer and the signal processing device in the first frequency range as mapping of a real transfer function via the feedback loop.

The device is also configured to assess the first transfer function as to whether an exceeding of a predetermined limit value by the real transfer function is to be expected from the behavior of the first transfer function in the environment of the first split-band frequency.

Furthermore, the device is configured, if an exceeding of a predetermined limit value by the real transfer function is not to be expected in the environment of the first split-band frequency, to increase the first split-band frequency to a second split-band frequency by such an amount that all the values of a gain of the first transfer function for frequencies less than the second split-band frequency are less than the predetermined limit value.

Finally, the device is configured, if an exceeding of a predetermined limit value by the real transfer function is to be expected in the environment of the first split-band frequency, to reduce the first split-band frequency to a second split-band frequency.

In addition, the device is configured to adjust in the hearing aid device a phase or frequency change for feedback suppression in the signal processing device only above an inception frequency in dependence on the second split-band frequency.

Furthermore, the invention relates to a system according to the invention of a hearing aid device and a device according to the invention. In this context, it is conceivable that the device is part of the hearing aid device, for example implemented as a separate unit, or also as part of the signal processing device of the hearing aid device. However, it is just as conceivable that the device is an external device and is implemented in a separate unit such as a remote control, a converter or also by an application on a smart phone.

The device according to the invention and the system according to the invention share the advantages of the method according to the invention.

In one conceivable embodiment of the method according to the invention, an exceeding of the predetermined limit value by the first transfer function is to be expected in the step of assessing the first transfer function if the first transfer function rises toward the first split-band frequency.

It is possible in a simple manner to determine function values for the estimated first transfer function in the environment above the first split-band frequency and to assess the behavior of the first transfer function in this manner, especially also to detect whether it rises toward the first split-band frequency. According to the finding according to the invention that the behavior of a real transfer function of the environment and of the hearing aid device is similar to the behavior of the estimated first transfer function above the first split-band frequency in an environment of the split-band frequency, the behavior of the real transfer function and thus the feedback behavior of the hearing aid device can be predicted in a simple manner for frequencies below the first split-band frequency. It is thus possible to expect and conclude from the fact that the first transfer function rises above the first split-band frequency that the real transfer function exceeds the limit value also below the first split-band frequency in a frequency range. Conversely, it is also possible to conclude, when the first transfer function does not rise, that the limit value is not exceeded by the real transfer function also below the first split-band function. Correspondingly, it is then possible to displace the first split-band frequency downward toward a second split-band frequency by this frequency range.

In a conceivable embodiment of the method according to the invention, a second transfer function of a feedback loop is determined in a third frequency range below the first split-band frequency in dependence on the first transfer function of the closed feedback loop. The determining can exhibit a deriving of the second transfer function from the first transfer function, for example in that a value of the lowest frequency of the first transfer function is assumed as a constant value of the second transfer function for the third frequency range or a part thereof or the second transfer function is interpolated linearly or in another manner from the first transfer function. Preferably, the third frequency range adjoins the first split-band frequency. Preferably, the third frequency range only comprises a part of the second frequency range, for example one half, one third, one quarter or one tenth of the bandwidth of the second frequency range.

Determining a second transfer function by interpolation advantageously enables a real transfer function of the acoustic environment and of the hearing aid device to be predicted more accurately even with a more complex behavior and the second split-band frequency to be determined even more reliably.

In a conceivable embodiment of the method according to the invention, the predetermined limit value of a gain of the first or second transfer function is 0 dB minus a stability margin.

At a gain of 0 dB in the feedback loop, the limit for feedback is reached. By determining the split-band frequency with a safety margin downward from the critical value, it is ensured in an advantageous manner that no unwanted feedbacks occur.

In a possible embodiment of the method according to the invention, after step (FIG. 3, S40) of increasing the split-band frequency or step (FIG. 3, S50) of reducing the split-band frequency, the method is continued with estimating a first transfer function of a closed feedback loop (FIG. 3, S20).

By estimating in each case again with a changed split-band frequency a changed first transfer function in a changed first frequency range, the method according to the invention is advantageously able to adapt to conditions changing in each case such as acoustic environment or changed seating of the hearing aid device.

In one embodiment of the method according to the invention, the split-band frequency is greater than 1 kHz.

Usually, feedbacks occur as whistling in higher frequency ranges. The method according to the invention advantageously restricts itself to a frequency range above 1 kHz in order to avoid artifacts in the range of the fundamental frequencies of the voice particularly sensitive to this and to save resources in the signal processing of the hearing aid device.

In one possible embodiment of the method according to the invention, the split-band frequency is less than 2 kHz.

The method according to the invention is based especially on the finding that below 2 kHz, a correlation occurs between the behavior of a feedback path at various frequencies. It is, therefore, possible especially in frequency ranges below 2 kHz to infer the properties of the feedback path at another frequency from estimated properties of a feedback path at one frequency. The method according to the invention makes use of this finding in order to advantageously determine from the estimated first transfer function above the split-band frequency a second transfer function in a third frequency range below the split-band frequency without having to estimate it elaborately.

Other features which are considered as characteristic for the invention are set forth in the appended claims.

Although the invention is illustrated and described herein as embodied in a method and apparatus with adaptive split-band frequency in hearing aid devices, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
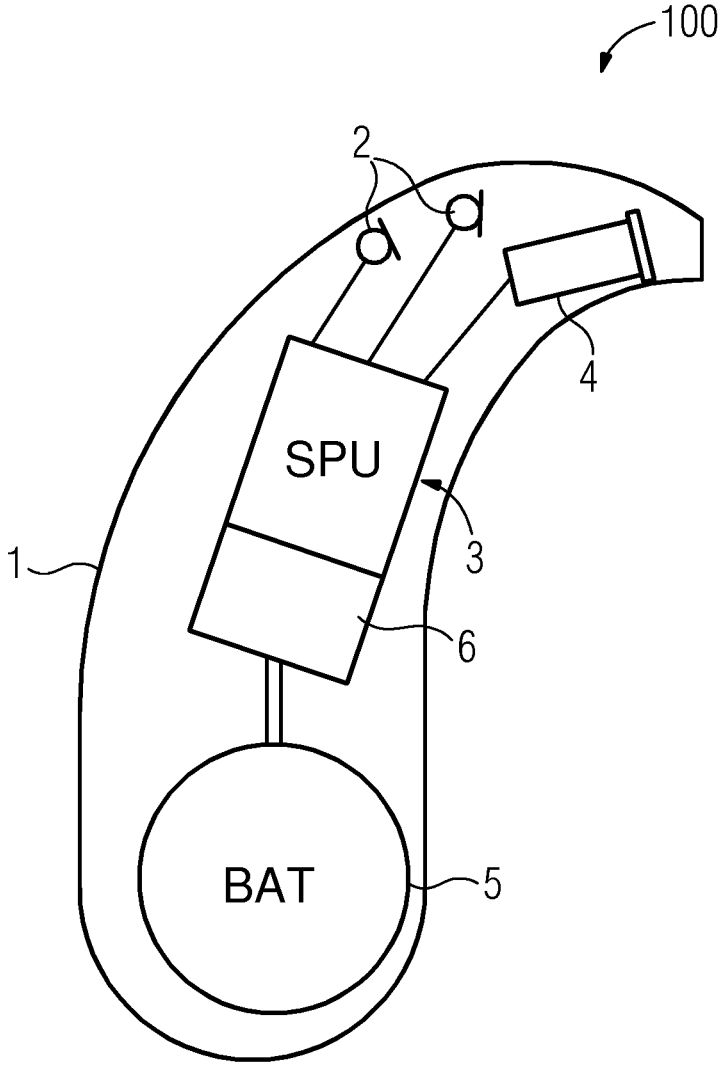
FIG. 1 shows an exemplary diagrammatic representation of a hearing aid device according to the invention.

Referring now to the figures of the drawing in detail and first, particularly, to FIG. 1 thereof, there is shown a basic configuration of a hearing aid device 100 according to the invention. In a hearing aid device housing 1 to be worn behind the ear, one or more microphones, also designated as acoustoelectric transducers 2, are installed for picking up the sound or acoustic signals from the environment. It should be understood that this is but one exemplary embodiment. The invention is not restricted to behind-the-ear (BTE) hearing aid devices but can also be applied in in-the-ear or in-canal hearing aid devices (ITE, ITC, CIC). The microphones 2 are acoustoelectric transducers 2 for converting the sound into first electrical audio signals. A signal processing device or signal processing unit (SPU) 3, which is also arranged in the hearing aid device housing 1, processes the first audio signals. The output signal of the signal processing device 3 is transmitted to a loudspeaker or earpiece 4 which outputs an acoustic signal. If necessary, the sound is transmitted via a sound tube which is fixed in the ear canal by means of otoplastic to the eardrum of the device wearer. However, another electromechanical transducer is also conceivable such as, for example, a bone conduction receiver. The power supply of the hearing device and especially that of the signal processing device 3 is effected by a battery 5 also integrated in the hearing device housing 1.

In addition, the hearing aid device 100 has a device 6 according to the invention for suppressing acoustic feedback. This is connected with respect to signals with the signal processing device 3 in order to acquire information about an acoustic signal picked up by the microphone 2 and a signal output to the earpiece 4. In addition, the device 6 is able to influence the signal processing device 3 via the signal connection, for example to activate a phase shift in a frequency range or to change this frequency range. In this context, it is similarly conceivable that the function of the device 6 is implemented in the signal processing device 3, for example as circuits in an ASIC or as function block in a signal processor.

Figure 2:
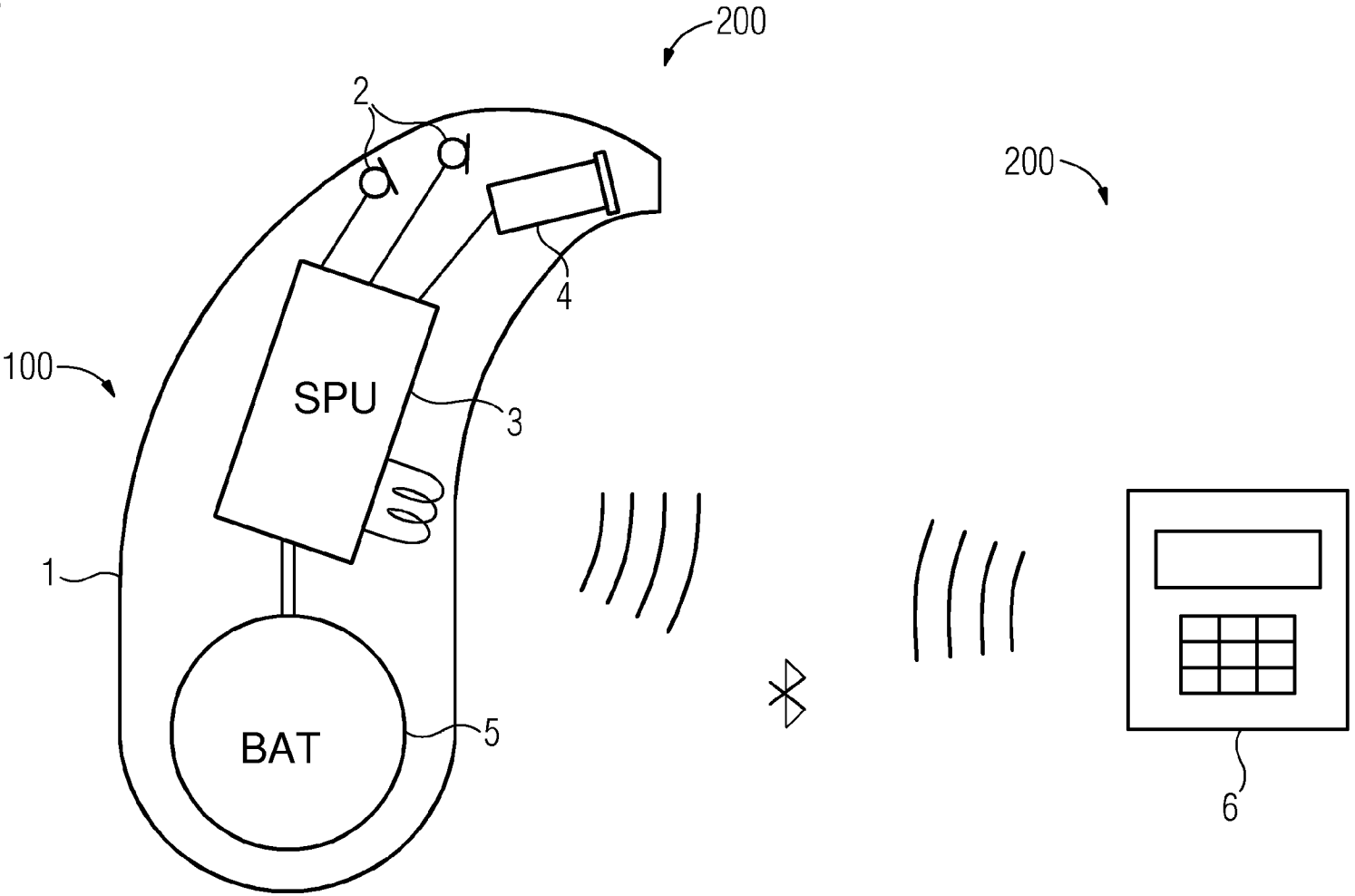
FIG. 2 shows a diagrammatic representation of a system according to the invention.

FIG. 2 shows the basic configuration of a system 200 according to the invention, consisting of a hearing aid device 100 and a separate device 6. The signal connection between the device 6 is here implemented preferably wirelessly, for example via an inductive coupling such as is also used for coupling in binaural hearing aid devices. However, other electromagnetic transmissions with low energy consumption such as, e.g., Bluetooth are also conceivable. Optical transmission or line-connected transmission are also conceivable.

In this context, the device 6 can be a dedicated device or also a multifunctional device such as a remote control, a media converter (e.g. Bluetooth on induction loop) or a smartphone. The device 6 for suppressing feedback and feedback artifacts has a processor or processing device that is configured to carry out the various functions ascribed to the device 6. The processor may be a dedicated system or integrated with the remaining processes.

Figure 3:
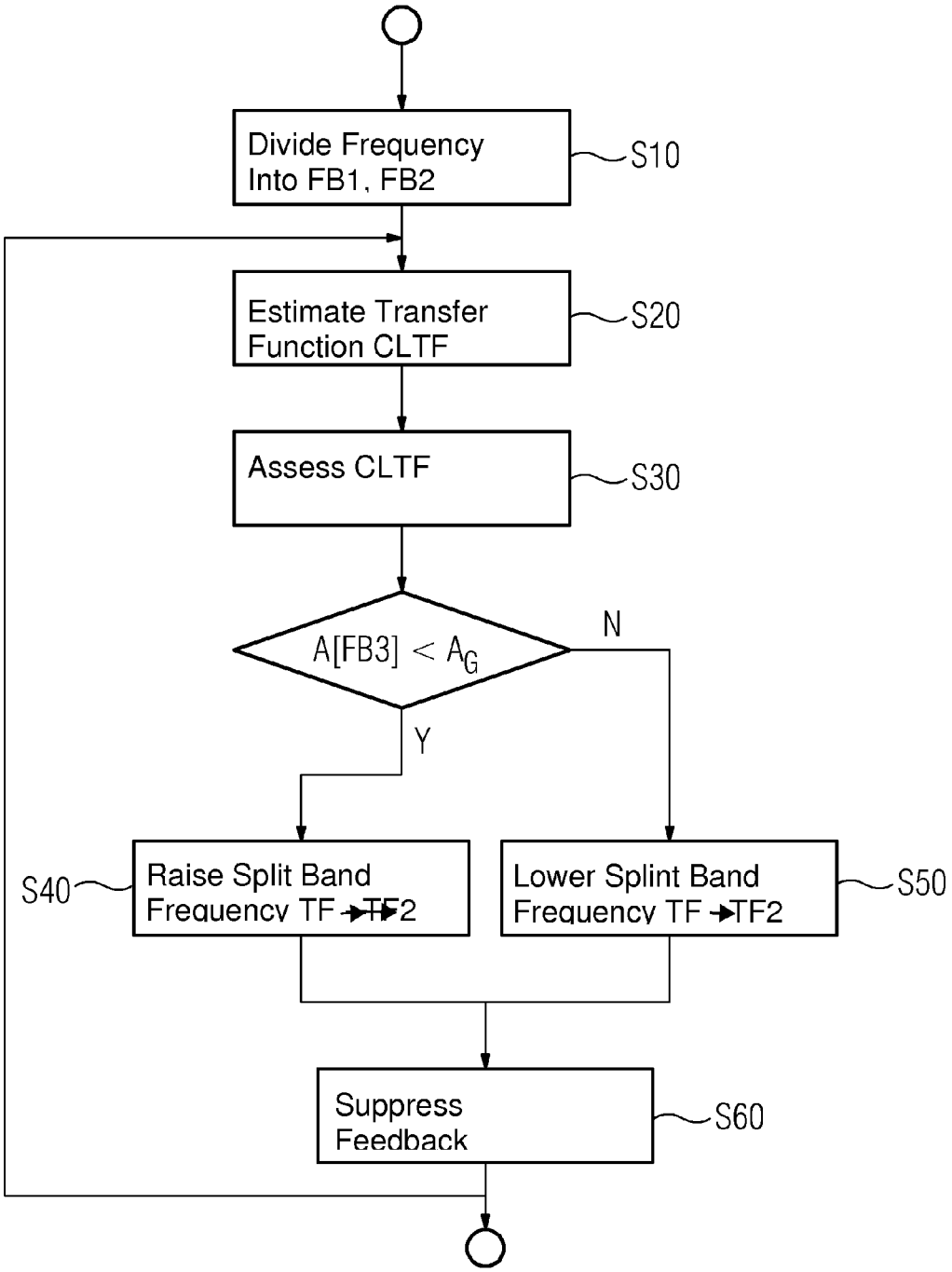
FIG. 3 shows a diagrammatic flow chart of a method according to the invention.

FIG. 3 shows a diagrammatic flow chart of a method according to the invention.

In a step S10, an acoustic frequency range transmitted by the hearing aid device 100 is divided into a first frequency range FB1 above a first split-band frequency TF and a second frequency range FB2 below the first split-band frequency TF. This dividing can occur in the signal processing device 3 or also in the device 6 itself. The first split-band frequency TF can assume a predetermined value or have resulted from preceding steps.

In a step S20, a first transfer function of a feedback loop (closed loop transfer function, CLTF) is estimated via the electroacoustic output transducer, an acoustic feedback path, the acoustoelectric input transducer and the signal processing in the first frequency range FB1. For the estimating, algorithms can be used, for example, which minimize an error between the real transmission or transfer function of the feedback loop via earpiece 4, microphone 2 and the signal processing 3 and a parameterized function and in this manner determine the parameters (e.g. LMS). This estimating function is usually part of a feedback suppression and is, therefore, only done for a frequency range jeopardized by feedback. According to the invention, this is the first frequency range FB1 above the first split-band frequency TF. The estimated transfer function is an approximated mapping of the real transfer function in the first frequency range FB1.

In order to enable the first transfer function to be estimated reliably also for correlated signals, it is conceivable in one embodiment of the method according to the invention, in particular, that a phase modulation and/or frequency shift is applied in the first frequency range FB1, the inception frequency of which is below the first split-band frequency TF. This ensures that with a steady increase in the shifting function, an adequate effect on the split-band frequency TF is achieved in order to be able to estimate the second transfer function reliably.

In a step S30, the first transfer function is assessed as to whether an exceeding of the predetermined limit value AG by the real transfer function is to be expected in an environment of the first split-band frequency TF. From the fact that the first transfer function is a parameterized approximation function for the real transfer function in the feedback loop in the first frequency range FB1, it is initially possible to infer from the behavior of the first transfer function the behavior of the real transfer function in the first frequency range FB1. Furthermore, the real transfer function obeys certain mathematical and acoustic laws so that it is possible to infer from values of the real transfer function for the first frequency range FB1, also function values in an adjacent frequency range FB2. In accordance with the invention, the behavior of the real transfer function in an environment of the first split-band frequency TF is therefore inferred from the values of the first estimated transfer function in the first frequency range FB1 in step S30.

In this context, environment, in the sense of the invention, is understood to be a frequency range which can also extend to frequencies outside the first frequency range FB1, for example to frequencies below the first split-band frequency TF. These can be frequencies directly below the split-band frequency TF, for example below by 20, 50 or 100 hertz. As is shown in the example of a transfer function in FIG. 4, further explained in the text which follows, a dropping behavior of the gain of the transfer function at a distance of up to one kilohertz can however also be assumed.

If, therefore, the first transfer function drops toward the first split-band frequency TF, a drop in the real transfer function can also be assumed for frequencies in a third frequency range FB3 below the first split-band frequency TF. The resulting assessment is then that the real transfer function does not exceed the predetermined limit value below the first split-band frequency TF up to a frequency spacing of 100, 200, 500 or even 1000 Hz.

In the simplest case, it can also be assumed for the assessment that the real transfer function retains, or at least does not exceed, the value of the first transfer function constantly immediately at or above the first split-band frequency TF.

However, it is also conceivable that a second transfer function of the closed feedback loop is determined in a third frequency range FB3 below the first split-band frequency TF in dependence on the first transfer function of the closed feedback loop. The third frequency range FB3 is below the first split-band frequency TF. Below the first split-band frequency TF, there is no estimation of the CLTF. However, there is a correlation between the behavior of the CLTF above the first split-band frequency TF and below the first split-band frequency TF so that, according to the invention, a second transfer function below the split-band frequency TF can be determined for the third frequency range FB3 from the first transfer function. This determining can be carried out in the simplest way in that for the second transfer function in a predetermined frequency range, for example the third frequency range FB3, a value of the first transfer function, e.g. the value at the lowest frequency for which this has been estimated, is assumed as a constant function value. The determining can be carried out, for example, also by linear or polynomial functions. Other functions are also conceivable. The determining of a transfer function by means of these functions advantageously requires a much lower expenditure of computing power than the estimating by means of acoustic signals. Depending on the selected function of determining, the result of the determining is particularly close to a real transfer function when the third frequency range FB3 is directly below the first split-band frequency TF. However, it is also conceivable that the third frequency range FB3 does not immediately adjoin the first split-band frequency TF. Since the correlation decreases with increasing frequency spacing, the third frequency range FB3 preferably only comprises a part of the second frequency range FB2.

In a conceivable step S40, the first split-band frequency TF is increased to a second split-band frequency TF2 if an exceeding of the predetermined limit value AG by the real transfer function is not to be expected in an environment of the first split-band frequency TF. This can be the case, for example, when the first transfer function drops toward the first split-band frequency TF, that is to say the function values become less with dropping frequency. In accordance with the exemplary transfer function in FIG. 4, however, it may already be sufficient if the function value of the first transfer function at the split-band frequency TF or in the immediate vicinity is less than the limit value AG of the gain.

The first split-band frequency TF can then be increased to a second split-band frequency TF2 so that all the values of a gain of the first transfer function of a closed feedback loop for frequencies less than the increased second split-band frequency TF2 are less than the predetermined limit value AG.

The predetermined limit value AG is obtained from the fact that the total gain of the closed feedback loop, taking into consideration the phase angle, must be less than or equal to one. In order to generate no feedback with an error during the determining and short-term fluctuations in the acoustic conditions, a safety margin is preferably provided in the choice of the predetermined limit value. This can be, for example, a spacing of −2 dB, −3 dB or −6 dB.

If a second transfer function had been determined in step S30 for assessment, it is ensured, if all values of the second transfer function determined are less than a predetermined limit value AG, that no feedback occurs below the previous first split-band frequency TF. For the estimated first transfer function which had been estimated in dependence on the frequency for the first frequency range FB1 above the original first split-band frequency TF, the frequency value is increased until the value of the estimated first transfer function is greater than or equal to the predetermined limit value AG. The increased second split-band frequency TF2 is then the last preceding frequency value. This ensures that for all values below the increased second split-band frequency TF2, the conditions for feedback are not given and, therefore, feedback suppression with possible artifacts can be dispensed with.

If it is to be expected from the assessment of step S30 that the limit value AG will be exceeded by the real transfer function, the first split-band frequency TF is lowered to a second split-band frequency TF2 in a step S50. The spacing of split-band frequency TF2 with respect to TF can be advantageously found in the curve of the exemplary transfer function of FIG. 4. Thus, for example, the limit frequency can be lowered by 100, 200, 500 or even 1000 Hz.

In this context, use is advantageously made of the fact that generally the gain of the hearing aid device for low frequencies with greater spacing from the split-band frequency TF of 100 Hz, 200 Hz or 500 Hz is below the feedback threshold in the second frequency range FB2.

If in step S30 a second transfer function was determined for the third frequency range FB3 below the first split-band frequency TF, the first split-band frequency TF can be reduced advantageously to a second split-band frequency TF2 by such an amount that all values of a gain of the second transfer function TF2 of a closed feedback loop for frequencies less than the reduced second split-band frequency TF2 are less than the predetermined limit value AG.

In a further step S60, a phase change is applied for suppressing feedback in the signal processing only below an inception frequency in dependence on the second split-band frequency TF2. As already shown, it is of advantage for estimating the first transfer function if the phase or frequency shift starts already below the split-band frequency TF so that reliable estimating is possible already at the split-band frequency TF or TF2 also for correlated signals. The inception frequency can be below the second split-band frequency TF2 for example by a fixed amount of, for example, 50 Hz, 100 Hz or 200 Hz or assume a value of the second split-band frequency reduced by a linear or other predetermined factor. It is conceivable that the dependence reflects the sensitivity of the ear for artefacts and in comparison with a spacing decreases linearly with respect to the split-band frequency TF or TF2, respectively.

As ensured in steps S40 and S50, the feedback conditions are not met for frequencies below this second split-band frequency TF2 so that no suppression measures are required and artifacts of the suppression function can be avoided in this frequency range.

In a conceivable embodiment of the method according to the invention, the method is continued with the second split-band frequency TF2 as new starting value with step S20, that is to say the first split-band frequency TF is set to be equal to the second split-band frequency TF2 and a new second split-band frequency TF2' is determined with steps S20 to S50. In this manner, the method according to the invention is able to adapt to changing acoustic conditions, either another room, other ambient noises or a changed seating of the hearing aid device.

Figure 4:
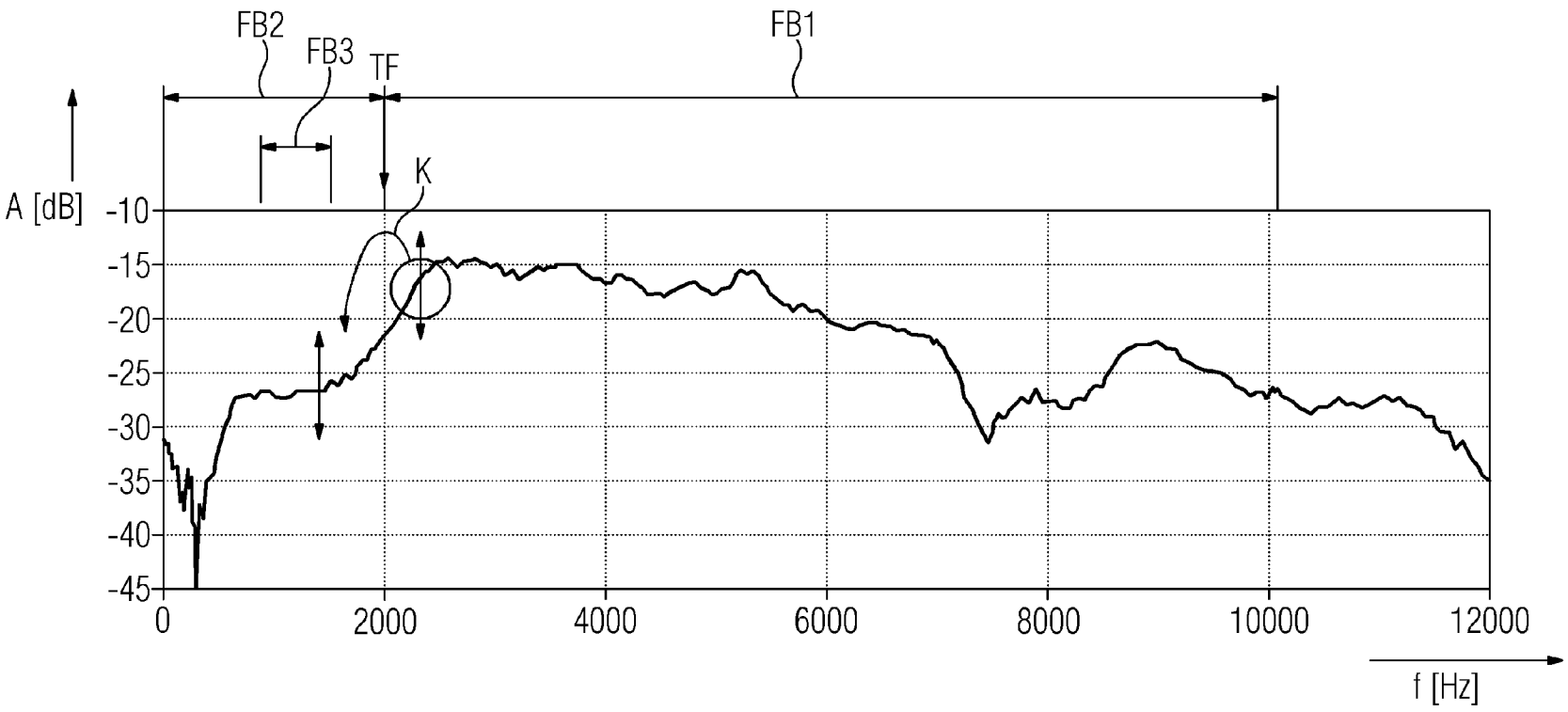
FIG. 4 shows an exemplary estimated transfer function of a feedback path.

FIG. 4 shows an exemplary estimated transfer function of a feedback path. The frequency f is plotted in Hz along the x axis, the gain of an exemplary CLTF is plotted in dB along the y axis. In the first frequency range FB1 above the split-band frequency TF, the CLTF is estimated as part of a feedback suppression which is activated in this first frequency range FB1. In the second frequency range FB2 below the split-band frequency TF, there if no feedback suppression and thus also no estimation of the transfer function CLTF. However, as indicated by the arrow K (for correlation), there is a relationship between the values of the transfer function above the split-band frequency TF and the values below. Therefore, it is also possible to determine from the estimated values for the frequency range FB1, a transfer function for a frequency range FB3 which is below the split-band frequency TF. For example, it could be assumed in simple approximation that the drop of the transfer function above FT continues into the range below FT and thus the transfer function remains below a predetermined limit value AG at which there is no feedback.

Figure 5:
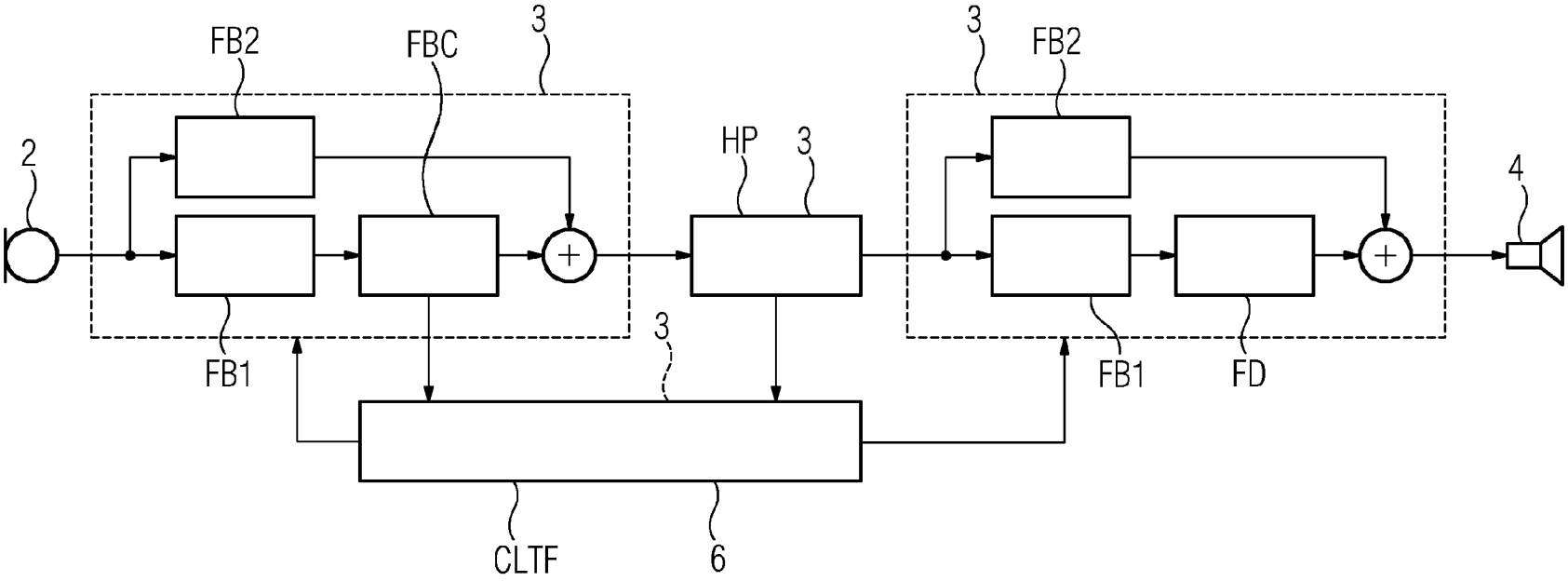
FIG. 5 shows a diagrammatic representation in function blocks of a possible implementation of a hearing aid device or system according to the invention.

FIG. 5 shows a diagrammatic representation in function blocks of a possible implementation of a hearing aid device or system according to the invention.

Firstly, components of a conventional hearing aid device are shown. A microphone 2 picks up an audio signal, converts it into an electrical signal which is prepared by signal processing HP of the hearing aid device according to the impairment of the hearing aid device wearer and is output to the ear of the wearer via an earpiece 4. Further components such as battery, housing or operating elements are not shown in FIG. 5 but are part of the hearing aid device according to the invention.

In the embodiment shown of the hearing aid device according to the invention, the audio signal of the microphone 2 is also divided into a first frequency range FB1 and into a second frequency range FB2. These can be done by separate high-pass and low-pass filters or a simple filter bank. Following this, the transfer function in the first frequency range FB1 is estimated by a feedback controller (FBC). Following the signal processing HP, a phase or frequency distortion is produced in the first frequency range FB1 in order to take counter measures against the feedback hazard detected by the feedback controller by changing the phase or producing a frequency shift. However, in order to detect a possible feedback hazard also in the frequency range FB2 which is not monitored by the feedback controller, the device 6 according to the invention, for suppressing feedback, receives information from the feedback controller FBC about the estimated transfer function and from the signal processing HP about further signal changes in the hearing aid device. The device 6 is therefore able, on the one hand, to determine a transfer function for a closed feedback loop CLTF for the first frequency range FB1 directly from the estimated external transfer function and, in accordance with the inventive concept, to determine by means of the correlation between the first frequency range FB1 and the second frequency range FB2 at least in a part range FB3 of the second frequency range FB2, a transfer function from the estimated transfer function for the first frequency range FB1. In this manner, the device 6 is able to increase the split-band frequency TF in various subunits of the hearing aid device when there is no feedback hazard and, in particular, to lower it when there is a feedback hazard in the second frequency range FB2.

In this context, the device 6 can be part of the internal signal processing 3, provided as separate device in the hearing aid device or also as external device which has a signal connection with the hearing aid device wirelessly or via a wire connection.

Although the invention has been illustrated and described in detail by the preferred exemplary embodiment, the invention is not restricted by the examples disclosed and other variations can be derived from it by the expert without leaving the scope of the invention.

The invention claimed is:

1. A method for suppressing acoustic feedback in a hearing aid device, wherein the hearing aid device has an acoustoelectric input transducer, a signal processing device, and an electroacoustic output transducer, the method comprising:

dividing an acoustic frequency range transmitted by the hearing aid device into a first frequency range above a first split-band frequency and a second frequency range below the first split-band frequency;

estimating a first transfer function mapping a real transfer function of a feedback loop via the electroacoustic output transducer, an acoustic feedback path, the acoustoelectric input transducer and the signal processing device in the first frequency range;

assessing the first transfer function to determine whether to expect the real transfer function to exceed a limit value from a behavior of the first transfer function in an environment of the first split-band frequency;

if the real transfer function is not expected to exceed the limit value in the environment of the first split-band frequency, increasing the first split-band frequency to a second split-band frequency, so that all values of a gain of the first transfer function for frequencies less than the increased second split-band frequency are less than the predetermined limit value; or if the real transfer function is expected to exceed the limit value in the environment of the first split-band frequency, reducing the first split-band frequency to a second split-band frequency; and applying a phase or frequency change for feedback suppression in the signal processing only above an inception frequency in dependence on the second split-band frequency.

2. The method according to claim 1, wherein the assessing step comprises determining to expect the real transfer function to exceed the limit value if the first transfer function rises toward the first split-band frequency.

3. The method according to claim 1, wherein the assessing step further comprises determining a second transfer function of the closed feedback loop in a third frequency range below the first split-band frequency in dependence on the first transfer function of the closed feedback loop and assessing whether the second transfer function exceeds the predetermined limit value in the third frequency range.

4. The method according to claim 1, wherein the reducing step comprises setting the second split-band frequency equal to the first split-band frequency minus a predetermined frequency spacing.

5. The method according to claim 1, wherein the predetermined limit value of a gain of the first or second transfer function is 0 dB minus a stability margin.

6. The method according to claim 1, which comprises, following the step of increasing the first split-band frequency or the step of reducing the split-band frequency, continuing with the step of estimating the first transfer function of the feedback loop.

7. The method according to claim 1, wherein the first split-band frequency is greater than 1 kHz and the second split-band frequency is greater than 700 Hz.

8. A device for suppressing acoustic feedback in a hearing aid device, the hearing aid device having an acoustoelectric input transducer, a signal processing device, and an electroacoustic output transducer, the device for suppressing acoustic feedback comprising: a signal connection to the hearing aid device; a processing device configured to: divide an acoustic frequency range to be transmitted by the hearing aid device into a first frequency range above a first split-band frequency and a second frequency range below the first split-band frequency; estimate a first transfer function as mapping of a real transfer function of a feedback loop via the electroacoustic output transducer, an acoustic feedback path, the acoustoelectric input transducer, and the signal processing device in the first frequency range; assess the first transfer function to determine whether to expect the real transfer function to exceed a limit value from a behavior of the first transfer function in an environment of the first split-band frequency; if the real transfer function is not expected to exceed the limit value in the environment of the first split-band frequency, increase the first split-band frequency to a second split-band frequency by such an amount that all the values of a gain of the first transfer function for frequencies less than the second split-band frequency are less than the predetermined limit value; or if the real transfer function is expected to exceed the limit value in the environment of the first split-band frequency, reduce the first split-band frequency to a second split-band frequency; and adjust in the hearing aid device a phase or frequency change for feedback suppression in the signal processing device only above an inception frequency in dependence on the second split-band frequency.

9. The device according to claim 8, wherein said processing device is configured, for assessment, to check the first transfer function to see whether the first transfer function rises toward the split-band frequency and, if so, to expect the real transfer function to exceed the predetermined limit value.

10. The device according to claim 8, wherein, for assessing the first transfer function, said processing device is configured to determine a second transfer function of the closed feedback loop in a third frequency range below the first split-band frequency in dependence on the first transfer function of the feedback loop and to assess whether the second transfer function exceeds the predetermined limit value in the third frequency range.

11. The device according to claim 8, wherein the processing device is configured to determine the second split-band frequency from the first split-band frequency minus a predetermined frequency spacing.

12. The device according to claim 8, wherein the predetermined limit value of a gain of the first or second transfer function is 0 dB minus a stability margin.

13. The device according to claim 8, wherein the processing device is configured to estimate a changed first transfer function to a changed split-band frequency and to determine a changed second transfer function to the changed split-band frequency.

14. The device according to claim 8, wherein the first split-band frequency is greater than 1 kHz and the second split-band frequency is greater than 700 Hz.

15. A hearing aid device with acoustic feedback suppression, comprising:

an acoustoelectric input transducer, a signal processing device connected to said input transducer, and an electroacoustic output transducer connected to said signal processing device;

a device for suppressing acoustic feedback connected, by way of a signal connection, to said signal processing device, and being configured to carry the following method steps:

dividing an acoustic frequency range transmitted by the hearing aid device into a first frequency range above a first split-band frequency and a second frequency range below the first split-band frequency;

estimating a first transfer function mapping a real transfer function of a feedback loop via the electroacoustic output transducer, an acoustic feedback path, the acoustoelectric input transducer and the signal processing device in the first frequency range;

assessing the first transfer function to determine whether to expect the real transfer function to exceed a limit value from a behavior of the first transfer function in an environment of the first split-band frequency;

if the real transfer function is not expected to exceed the limit value in the environment of the first split-band frequency, increasing the first split-band frequency to a second split-band frequency, so that all values of a gain of the first transfer function for frequencies less than the increased second split-band frequency are less than the predetermined limit value; or if the real transfer function is expected to exceed the limit value in the environment of the first split-band frequency, reducing the first split-band frequency to a second split-band frequency; and applying a phase or frequency change for feedback suppression in the signal processing only above an inception frequency in dependence on the second split-band frequency.

16. The hearing aid device according to claim 15, wherein said device for suppressing acoustic feedback to the hearing aid device is directly connected to, or integrated in, said signal processing device.

17. The hearing aid device according to claim 15, wherein said device for suppressing acoustic feedback to the hearing aid device is disposed separate from and connected to said signal processing device by way of a wireless signal connection.

18. The method according to claim 1, wherein the assessing step comprises determining from the first transfer function, above the first split-band frequency, the behavior of a transfer function below the first split-band frequency.

19. The device according to claim 8, wherein said processing device is configured to determine from the first transfer function, above the first split-band frequency, the behavior of a transfer function below the first split-band frequency.

* * * * *